US008528147B2

(12) United States Patent
Larsson et al.

(10) Patent No.: US 8,528,147 B2
(45) Date of Patent: Sep. 10, 2013

(54) INTERDENTAL BRUSH

(75) Inventors: Jan-Inge Larsson, Veberod (SE); Bengt Sare, Genarp (SE); Paul Wallstrom, Limhamn (SE)

(73) Assignee: TePe Munhygienprodukter AB, Malmö (SE)

( * ) Notice: Subject to any disclaimer, the term of this patent is extended or adjusted under 35 U.S.C. 154(b) by 231 days.

(21) Appl. No.: 12/302,459

(22) PCT Filed: May 30, 2007

(86) PCT No.: PCT/EP2007/055154

§ 371 (c)(1), (2), (4) Date: Nov. 25, 2008

(87) PCT Pub. No.: WO2007/138030

PCT Pub. Date: Dec. 6, 2007

(65) Prior Publication Data

US 2009/0235477 A1 Sep. 24, 2009

Related U.S. Application Data

(60) Provisional application No. 60/809,248, filed on May 30, 2006.

(30) Foreign Application Priority Data

May 30, 2006 (SE) ..... 0601185

(51) Int. Cl.
*A46B 9/04* (2006.01)

(52) U.S. Cl.
USPC ..... 15/167.1

(58) Field of Classification Search
USPC ..... 15/167.1, 167.2, 22.1, 22.2, 25, 26, 15/176.6
See application file for complete search history.

(56) References Cited

U.S. PATENT DOCUMENTS

| | | | | |
|---|---|---|---|---|
| 2,634,722 | A | 4/1953 | Jackson | |
| 4,691,404 | A | 9/1987 | Tarrson et al. | |
| 4,751,761 | A | 6/1988 | Breitschmid | |
| 5,138,733 | A * | 8/1992 | Bock | 15/22.1 |
| 5,435,033 | A | 7/1995 | Millner | |
| 5,488,751 | A * | 2/1996 | Gekhter et al. | 15/167.1 |
| 5,855,216 | A * | 1/1999 | Robinson | 132/322 |
| 6,325,626 | B1 * | 12/2001 | Blass | 433/141 |
| 2003/0019062 | A1 | 1/2003 | Florence | |
| 2005/0278874 | A1 * | 12/2005 | Blaustein et al. | 15/22.1 |

FOREIGN PATENT DOCUMENTS

| | | |
|---|---|---|
| CA | 2545264 | 5/2005 |
| DE | 19522502 | 6/1995 |
| EP | 1683439 | 11/2004 |
| EP | 1862090 | 5/2007 |

(Continued)

OTHER PUBLICATIONS

Tepe Pamphlet, Mar. 2005, pp. 10 and 11, Tepe Munhygienprodukter AB, Malmo, Sweden.

*Primary Examiner* — Robert Scruggs
(74) *Attorney, Agent, or Firm* — Lowe Graham Jones PLLC

(57) ABSTRACT

An interdental brush comprises a brush member having bristle filaments attached to a spine which projects from a handle part. The handle part comprises a main body and a resilient transition portion. The handle part further comprises a hollow cavity, in the transition portion. The hollow cavity improves the cushioning effect of the transition portion, and increases the length of stroke of the interdental brush by allowing the transition portion to be deformed.

22 Claims, 3 Drawing Sheets

(56) References Cited

FOREIGN PATENT DOCUMENTS

Figure 1:
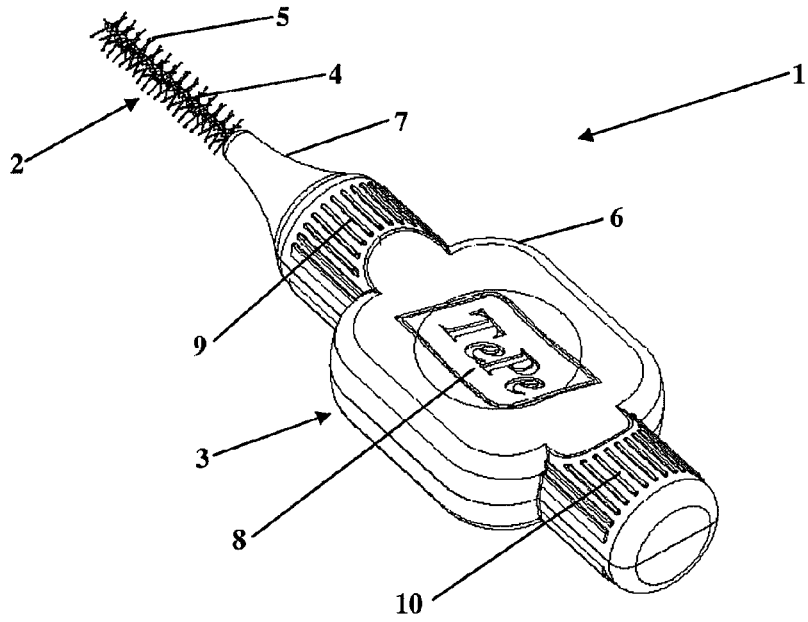

| | | |
|---|---|---|
| GB | 2401782 | 6/2003 |
| JP | 0446576 | 11/1992 |
| JP | 0446577 | 11/1992 |
| JP | 09168426 | 6/1997 |
| JP | 2002253344 | 9/2002 |
| JP | 2003250633 | 9/2003 |
| JP | 2003265503 | 9/2003 |
| JP | 2005224268 | 8/2005 |
| WO | WO8602532 | 5/1986 |
| WO | WO0112012 | 2/2001 |
| WO | WO0134058 | 5/2001 |

* cited by examiner

INTERDENTAL BRUSH

PRIORITY CLAIM

This application is a national phase of PCT/EP2007/055154 filed May 30, 2007, which claims priority to U.S. Provisional Application Ser. No. 60/809,248 filed May 30, 2006 and Swedish Application Serial No. 0601185.2 filed May 30, 2006, the contents of which are hereby incorporated by reference.

FIELD OF THE INVENTION

This invention relates to the field of dental hygiene and devices therefor, and more specifically to interdental brushes. Interdental brushes are used by dentists and dental hygienists in clinics, as well as by consumers themselves at home. The function of an interdental brush is to clean the interdental space, i.e. the space between two adjacent teeth. Keeping the interdental spaces clean by removing biofilm, i.e. plaque, and lodged particles reduces the risk of caries and gingival disease, and also has a beneficial effect on the user's oral hygiene generally.

BACKGROUND ART

Interdental brushes have been in use for a considerable length of time. Among early contributions to the body of prior art is U.S. Pat. No. 4,691,404. The interdental brush disclosed therein comprises a brush part consisting of bristles secured to a spine of twisted metal wires. The spine is embedded in a handle made of a mixture of a thermoplastic elastomer and a polypropylene material. The brush part is fastened to the handle by means of in-situ injection moulding of the handle onto the spine of the brush part.

An alternative way of securing the spine of the brush part to the handle is known from interdental brushes on the market. Here, the handle is not moulded in-situ onto the spine of the brush part. Instead, the handle of a relatively rigid polymer material, such as polypropylene, consists of two halves, each of which is formed separately, typically by means of injection moulding. The halves are fastened to each other with the spine of the brush part secured between them. A similar concept is shown in JP-A-2003-250633. JP-Y-04-46576 discloses an interdental brush with a twisted wire brush and a handle made of a relatively hard or rigid plastic. At an end of the handle, where the spine of the twisted wire brush protrudes, there is provided a substantially cylindrical recess. The recess is filled with a body of a soft, rubber-like material. The spine of the twisted wire brush extends through the body of rubber-like material and is embedded in the plastic handle. The point of this rubber-like body is that when the brush part during use is redirected at an angle relative to the longitudinal axis of the handle, the spine is not bent sharply at one single point. Instead, it is bent smoothly along a longer part of the spine inside the rubber-like body. This reduces the metal fatigue of the spine and hence increases the life-span of the interdental brush.

WO-A-01-34058 suggests an interdental brush with a brush part, a twisted wire spine of which is embedded in a main body of a handle made of a relatively hard or rigid plastic. At a front end of the handle, where the twisted wire spine of the brush part protrudes, there is provided a surface layer of a soft, elastomeric material. The elastomeric surface layer has a supposed cushioning effect, such that the gums are not hurt or damaged when the front end of the handle is accidentally pushed against them during use. A method of manufacture is suggested where the elastomeric material is in-situ moulded onto the hard plastics and the spine. A similar concept is shown in JP-Y-04-46577.

JP-A-09-168426 discloses an interdental brush which comprises a wire brush, a handle body of a hard synthetic resin, and a deformable member of a soft synthetic resin. This deformable member has one end embedded in the handle body, while the other end projects from the handle body. The spine of the wire brush extends through the deformable member of soft synthetic resin and is embedded in the handle body. A method of manufacturing is also suggested, in which the handle body is moulded in-situ onto a combined body comprising the wire brush and the deformable member of soft synthetic resin. However, the soft member of this prior-art brush has insufficient cushioning effect.

Further examples of interdental brushes are disclosed in CA-A-2,545,264 and U.S. Pat. No. 5,435,033. The interdental brushes disclosed in these two documents have no cushioning effect at all.

SUMMARY OF THE INVENTION

While the applicant considers the solutions offered so far in this area to be of some merit, it is maintained that some problems remain to be solved.

First of all, the supposed cushioning effect claimed by interdental brushes of the prior art is relatively small, since the elasticity of a surface layer of elastomeric material provided adjacent to a harder material is very limited. Hence, it is a first object of this invention to significantly improve the cushioning effect of an elastic front end of an interdental brush. An improved cushioning effect reduces the risk of damage to the gum and makes the interdental brush more comfortable to use.

Secondly, all interdental brushes of the prior art have a limited length of stroke. By length of stroke is meant the distance that the brush part of the interdental brush can be inserted into the interdental space. An increased length of stroke is associated with improved cleaning efficacy. A second object of this invention is thus to provide an interdental brush with an increased length of stroke.

Finally, since interdental brushes are manufactured in a mass production process and are sold at a relatively low price, an interdental brush should be so configured that it is relatively easy and problem-free to produce. Hence, it is an additional object of this invention to suggest a configuration for an interdental brush with an elastic front end, which makes its manufacture more efficient and less susceptible to disturbances. In particular, this effort is directed towards a means for attaching an elastic front end to the rest of the handle part, which avoids in-situ moulding.

The present invention proposes to fulfil the objects outlined above by providing a completely novel interdental brush, as claimed in appended claim 1, in which there is provided a hollow cavity inside the elastic front end of the handle. The inventive interdental brush comprises the principal components of a brush member and a handle part. The brush member projects from a front end of the handle part, and may preferably, in conventional manner, comprise bristle filaments secured to a spine. The handle part comprises a transition portion and a hollow cavity. The handle part may further comprise a main body, which may, in conventional manner, be made of a relatively rigid material, preferably a polymer such as, for example, polypropylene. The transition portion forms the front end of the handle part and has elastic or resilient properties. Preferably, it comprises a suitably elastic material, such as thermoplastic elastomer. The hollow cavity, typically filled with air, is provided inside the handle part, at the front end so that it is within, or adjacent to, the transition portion. Preferably, the spine of the brush member extends through the transition portion, through the hollow cavity, and is secured to the main body of the handle part. The transition portion may be of any shape, e.g. cylindrical, triangular or pyramidal. This novelty improves on the interdental brushes known to the prior art in at least the following two principal ways.

Firstly, the cushioning effect of the transition portion is enhanced due to the provision of a shock absorbing layer of air underneath it. This gives the interdental brush of the present invention superior comfort and reduces the risk of pain in, or damage to, the teeth and the gum tissue.

Secondly, since the hollow cavity gives the transition portion improved capacity to be deformed and compressed, compared to the solid front end parts of the interdental brushes of the prior art, the interdental brush on which it is utilised is enabled to be inserted further into the interdental space, thereby increasing the length of stroke. The compression, or deformation, of the transition portion and the hollow cavity may take place both in the horizontal direction, whereby a wall of the transition portion is pushed against the spine, and in the vertical direction, whereby the top end of the transition portion may recede along the spine. Typically, the volume of the hollow cavity will be reduced as the transition portion is subjected to external force. An increased length of stroke may be desirable for different reasons. Longer interdental spaces can be cleaned, given any maintained brush length. Alternatively, the brush length can be shortened with maintained ability to clean long interdental spaces. Generally, with a longer stroke, more bristle filaments pass each point of the tooth wall per stroke, thus improving the cleaning effect per stroke. Apart from these two main advantages of the hollow cavity of the present invention, it has an additional advantage in that it, by being hollow, saves material. This is advantageous both from a production cost perspective, as well as from an environmental point of view.

As a method for manufacturing an interdental brush with an elastic front end part, i.e. transition portion, the prior art suggests in-situ moulding, of either the main body onto the transition portion and spine, or of the transition portion onto the main body and spine. In the case of a hollow cavity, neither of these methods is suitable, since it would be difficult to prevent the mould mass to fill up the hollow cavity during the process. A novel method for assembling the interdental brush of the present invention is thus required. In particular, a novel way of attaching the transition portion to the main body of the handle part is needed, which does not involve in-situ moulding. The applicant proposes that this be solved by securing the transition portion to the main body by mechanical means. Such mechanical means may consist in a mechanical interlocking mechanism. The mechanical interlocking mechanism may comprise a recess in the main body, a part protruding from a wall on the inside of said recess, and a flange protruding from the outside of the transition portion, such that when the transition portion is embedded in the main body in said recess, the protruding flange on the transition portion engages the protruding part on the wall on the inside of the recess. This mechanism may be utilised in a handle part, the main body of which comprises two halves, each of which are formed separately, and secured to each other by some means other than injection moulding.

Hence a configuration for an interdental brush with an elastic front end part has been suggested, which allows the manufacturer to avoid in-situ injection moulding. This is an advantage, since in-situ moulding is associated with technical difficulties, because it is difficult to construct a moulding tool which is able to shut tightly around the uneven surface of the spine. The result is frequent leakage and production stops. Another advantage of avoiding in-situ moulding of the front end of the handle part is that bristle filaments may be arranged all the way down to the top end of the transition portion. In the case of in-situ moulding, a bristle-free part of the spine has to be left next to the front end of the handle part, for the moulding tool to be able to seal off the moulding cavity.

Further embodiments of the invention are set forth in the appended subclaims.

BRIEF INTRODUCTION OF THE DRAWINGS

Figure 2:
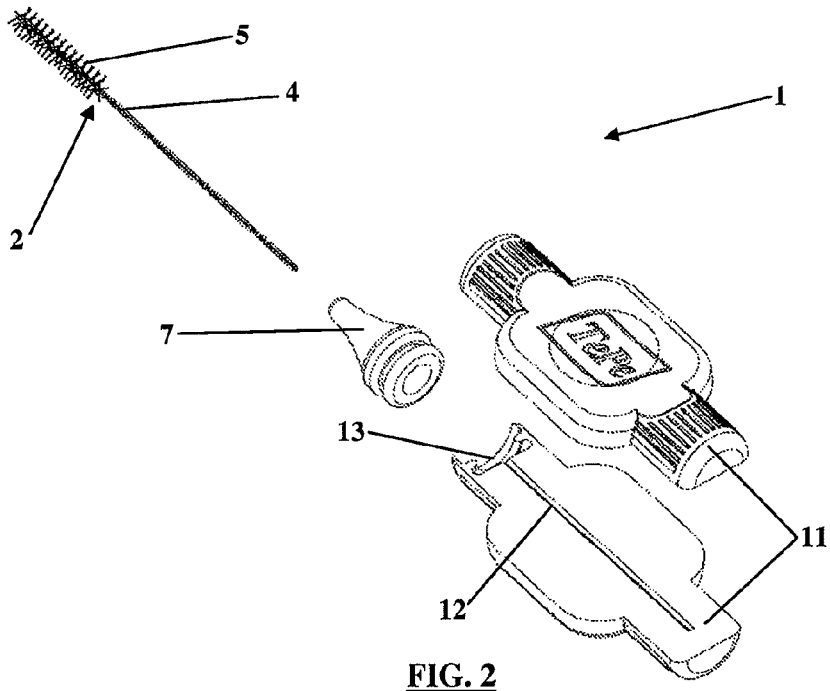
Figure 3:
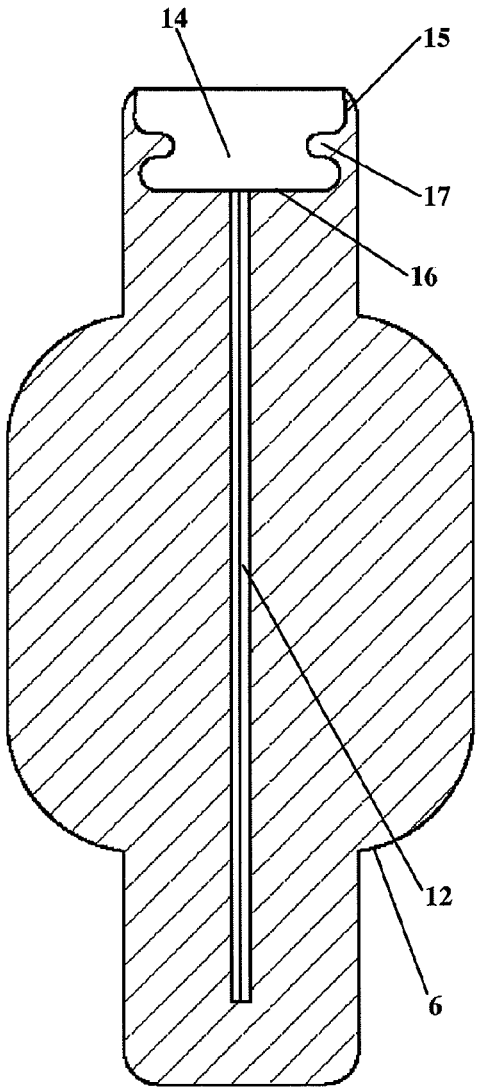
Figure 4:
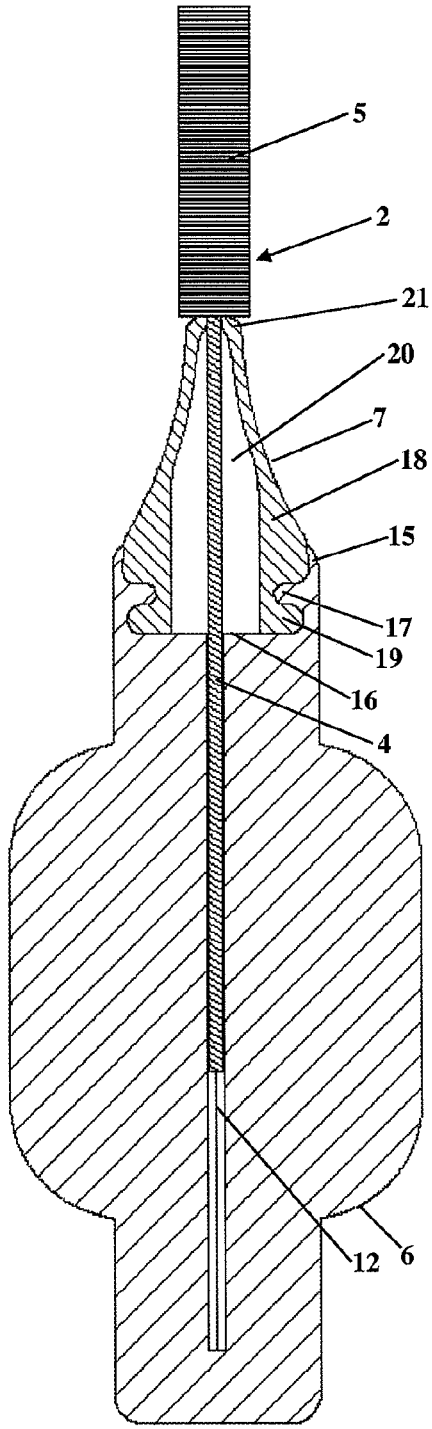
Figure 5:
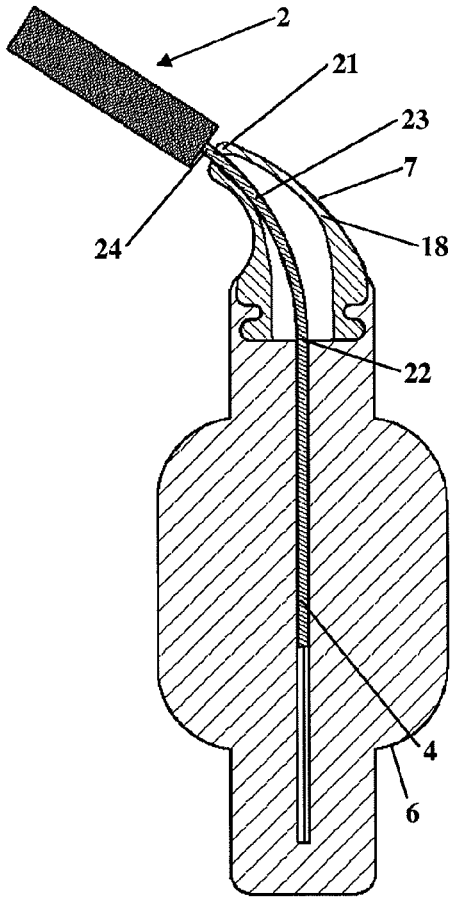
Figure 6:
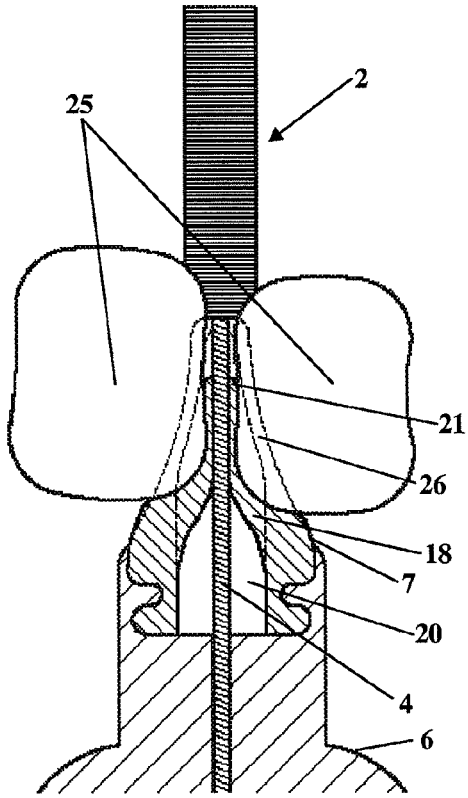

Non-limiting embodiments of the invention will now be described in greater detail with reference to the drawings, in which:

FIG. 1 shows the preferred embodiment of the interdental brush of the present invention in its finished, fully assembled, ready-to-use form FIG. 2 shows the preferred embodiment of FIG. 1 in an exploded view, FIG. 3 shows schematically the main body of the handle part of the preferred embodiment of FIG. 1, in a cross-sectional view, FIG. 4 shows schematically the preferred embodiment of FIG. 1, in a cross-sectional view, whilst in a relaxed state, FIG. 5 shows schematically the preferred embodiment of FIG. 1, in a cross-sectional view, whilst being bent, and FIG. 6 shows schematically a part of the preferred embodiment of FIG. 1, in a cross-sectional view, whilst being introduced between two adjacent teeth.

DESCRIPTION OF PREFERRED EMBODIMENTS

Referring to the figures, initially FIGS. 1-4, a preferred embodiment of the interdental brush of the present invention is designated 1. It comprises a brush member 2 and a handle part 3. The brush member 2 of the interdental brush 1 comprises a spine 4, and a plurality of bristle filaments 5, secured to a distal end of the spine 4. A variety of alternatives are available in terms of material choices and means for securing the bristle filaments 5 to the spine 4. In the preferred embodiment, the spine 4 which is made of metal wire coated with plastics, engages the bristle filaments 5 made of polyamide by twisting. This twisting, well known in the art, involves folding a length of wire into a spine 4 with two legs, disposing bristle filaments 5 between the two legs along a length of the distal end of the spine 4, and twisting the spine 4 so that the bristle filaments 5 are secured between the legs of the spine 4. Apart from these conventional choices concerning materials and means of securing the bristle filaments 5 to the spine 4, other options are available without altering the effect of the invention. Hence, any polymer filament or natural fibre may be used as bristle filaments 5. The spine 4 may comprise a wire made of polymer material, or a metal wire, in particular a nickel-free metal wire, without plastic coating. The bristle filaments 5 may be secured to the spine 4 by means of gluing, melting, welding, flocking etc. In the preferred embodiment, the outer ends of the bristle filaments 5 roughly define a cylinder. Any other shape is, however, possible without altering the effect of the invention.

The handle part 3 comprises a main body 6 and a transition portion 7, here in the form of an elastic tip. The portion 7 forms a transition between the main body 6 of the handle part 3 and the brush member 2. The main body 6 is, in the preferred embodiment, shaped so as to have a relatively flat, substantially quadrangular grip part 8, a substantially cylindrical upper end part 9, and a similarly substantially cylindrical lower end part 10. Any other handle shape is possible, without altering the effect of the invention, e.g. a cylindrical shape, a triangular shape, and an elongated, angled shape. With the shape offered as in the preferred embodiment, easy and comfortable gripping is provided by means of the grip part 8, while the similarly shaped upper end part 9 and lower end part 10 may optionally be used to engage a cap (not shown), in this case of a substantially cylindrical configuration. Such a cap may be attached to the upper end part 9 to function as a protective cover while not in use and may be attached to the lower end part 10 during use, to lengthen the handle part 3 of the interdental brush 1.

The main body 6 consists, in the preferred embodiment, of two identical halves 11. Each of the halves 11 has a groove 12 for receiving the spine 4 of the brush member 2. At the upper end part 9 of the main body 6, the halves 11 each have a recess half 13 of semi-circular horizontal cross-sectional shape. When the halves 11 are fitted together, a recess 14 of circular horizontal cross-sectional shape is formed, in which the transition portion 7 is embedded. The recess 14 is defined by a recess wall 15 and a recess floor 16. On the recess wall 15 there is provided a protruding part 17.

The main body 6 of the handle part 3 of the preferred embodiment is made of polypropylene. This material is preferred due to its combination of the characteristics of inexpensiveness, suitability for injection moulding and functional mechanical properties. Any relatively rigid material, giving the construction appropriate stability, could be functional, although a thermoplastic material is preferable due to its suitability for injection moulding. Among the class of thermoplastic materials there are, however, many alternatives. The exact choice of material for the main body 6 is not critical to the invention.

The transition portion 7 has, in the preferred embodiment, a tapered outside shape of circular horizontal cross-section. The tapered shape assists the transition portion 7 to penetrate into the interdental spaces, thereby improving the length of stroke, while a rounded or circular cross-sectional shape improves comfort by avoiding any sharp edges. Any variation in terms of outer shape, such as a tapered shape of triangular or square cross section, or a non-tapered cylindrical, triangular or square shape etc., is, however, within the scope of the invention.

The preferred embodiment of the transition portion 7 has a wall 18, on the outside of which there is provided a protruding flange 19. The part of the transition portion 7 where the protruding flange 19 is provided is embedded in the recess 14 of the main body 6, such that the protruding flange 19 engages the protruding part 17 on the recess wall 15. The transition portion 7 is thus held in place by the main body 6, secured thereto by mechanical means comprising interlocking protrusions.

The inside of the wall 18 is in the preferred embodiment smooth. It may alternatively be supplied with grooves or protrusions, in particular longitudinally extending ones, in order to improve the stability of the transition portion 7.

Inside the transition portion 7 there is provided a hollow cavity 20. In the preferred embodiment, the hollow cavity 20 is shaped as a cylinder, which tapers towards a top end 21 of the transition portion 7. The hollow cavity 20 may, however, be shaped in other ways without fundamentally altering the effect of the invention. The hollow cavity 20 may be substantially enclosed by the transition portion 7 alone, or, as in the preferred embodiment, by the transition portion 7, along with the recess floor 16. Letting the hollow cavity 20 be substantially enclosed makes the transition portion 7 relatively stable. The fact that the hollow cavity 20 is substantially enclosed does not exclude the option that there may be provided holes in the main body 6 or transition portion 7, joining the hollow cavity 20 with the outside of the handle part. There may be more than one hollow cavity.

The preferred material for the transition portion 7 is a thermoplastic elastomer. This material combines the desirable features of softness and elasticity and has the further advantage that it can be processed by means of injection moulding. However, any relatively elastic or resilient material may be used and is thus within the scope of the invention. Other options that might be explicitly mentioned are rubber, natural or synthetic, and various foam-like and sponge-like materials.

The preferred embodiment of the interdental brush 1 is configured so that the spine 4 of the brush member 2 extends through the transition portion 7. The spine 4 enters the transition portion 7 through a hole at a top end 21 thereof, and extends through the hollow cavity 20 to meet the groove 12 of the main body 6 at the recess floor 16. The spine 4 extends into the groove 12 and is thus embedded in, and secured to, the main body 6. Securing the spine 4 to the main body 6 of the handle part 3 in this manner gives the brush member 2 excellent stability, in particular if the main body 6 of the part 3 is made of substantially rigid material.

The top end 21 of the transition portion 7 may touch the spine 4. Preferably, however, neither the top end 21, nor any other part of the transition portion 7, is secured to the spine 4 or any other part of the brush member 2.

Each of the component bodies, i.e. the brush member 2, the transition portion 7 and each of the halves 11 of the main body 6, is, in the preferred embodiment, formed separately and then assembled. The brush member 2 may preferably be manufactured in the conventional way already described, whereas the transition portion 7 and each of the halves 11 of the main body 6 are preferably formed by means of conventional injection moulding.

The manufacturing of the inventive interdental brush 1 may then be completed with the two steps of threading the transition portion 7 onto the spine 4 of the brush member 2, and fitting the two halves 11 of the main body 6 together, such that the spine 4 becomes secured between the halves 11, and such that said transition portion 7 becomes fastened to said main body 6.

These two steps may take place in any order. The halves 11 and the spine 4 may be secured to each other by any conventional means such as gluing, welding, melting, or mechanical means.

Turning to FIGS. 5-6, the advantages of the present invention, in particular its preferred embodiment, will be further elucidated. When the brush member 2 is bent, either by the finger of the user or due to the deformation forces resulting from inserting the brush in hard-to-reach interdental spaces far back in the mouth, the spine 4 is not bent sharply at the point 22, where it leaves the main body 6, as is characteristic of interdental brushes without an elastic front end portion. Instead, the spine 4 is bent smoothly over a longer bent portion 23 of the spine 4, since the transition portion 7 is deformed in response to the pressure. The advantage associated with this, i.e. that material fatigue, in particular metal fatigue, is reduced due to avoidance of sharp bends of the spine 4, was known to elastic front end parts of the prior art, but is further improved by the present invention. Since the transition portion 7 is not fastened to the spine 4, not even at the top end 21, said top end 21 of the transition portion 7 is allowed to recede slightly in response to bends, as is shown by an exposed portion 24 of the spine 4 in FIG. 5. This further reduces material stress and gives the interdental brush 1 of the present invention excellent durability. When the pressure that is applied to bend the brush member 2 is removed, the resilience of the transition portion 7 will tend to restore the spine 4 to its original, upright position.

When the interdental brush 1 is introduced into the interdental space between two adjacent teeth 25, the transition portion 7 may be pushed against the teeth 25 and the underlying gum. In response to the mechanical pressure that the transition portion 7 is thereby subjected to, it is compressed. The wall 18 will implode, partly filling up the hollow cavity 20 and exerting pressure on a part of the spine 4. Furthermore, since the top end 21 of the transition portion 7 is not secured to the spine 4, said top end 21 may recede in response to pressure. The air of the hollow cavity 20 may during compression be pushed out through the hole at the top end 21. There may also be provided separate air-holes in the main body 6 or the transition portion 7. The deformation potential of the transition portion 7 of the interdental brush 1 of the present invention is demonstrated in FIG. 6, where a compressed state of the transition portion 7 is contrasted to its original state 26.

Compared to an interdental brush of the prior art, the interdental brush 1 of the present invention has superior cushioning effect and superior length of stroke, due to its hollow cavity 20. The body of air in the hollow cavity 20 has a shock absorbing effect and thus protects the gums and teeth from collision damage, while the supreme conformability yielded by the hollowness of the transition portion 7 allows it to penetrate deeply into interdental spaces of various shapes.

The embodiments of the invention in which an exclusive property or privilege is claimed are defined as follows:

1. An interdental brush comprising:

a handle part having a main body and a substantially resilient transition portion forming a front end of said handle part, said handle part further comprising a hollow cavity within said transition portion; and a brush member projecting from a front end of said handle part, said brush member having a spine and a plurality of bristles coupled to said spine, said bristles each extending about perpendicular to said spine, wherein said spine is fixedly secured directly to and embedded in said main body, said spine being substantially elastically bendable along its portion extending beyond said main body, said spine extending from said main body through said hollow cavity, the portion of the spine within the hollow cavity not being embedded in substantially non-elastic material, and wherein at least a portion of said transition portion contacts said spine of said brush member.

2. An interdental brush according to claim 1, wherein said main body of said handle part is substantially rigid, said main body of said handle part not extending substantially into said hollow cavity of said transition portion and thereby said main body of said handle part not substantially contacting said spine that is within said hollow cavity of said transition portion.

3. An interdental brush according to claim 1, wherein said hollow cavity is filled with air, the portion of said spine that is within said hollow cavity being free to elastically flex within the walls of said cavity.

4. An interdental brush according to claim 1, wherein said hollow cavity is substantially enclosed, without rigid support between said hollow cavity and said spine.

5. An interdental brush according to claim 4, wherein said hollow cavity is substantially enclosed by said transition portion together with said main body of said handle part.

6. An interdental brush according to claim 4, wherein said hollow cavity is substantially enclosed by said transition portion alone.

7. An interdental brush according to claim 1, wherein the volume of said hollow cavity is reduced when said transition portion is subjected to external force.

8. An interdental brush according to claim 1, wherein said spine extends through said transition portion and said hollow cavity and is secured to said main body of said handle part, said spine being free to resiliently flex within said hollow cavity.

9. An interdental brush according to claim 8, wherein a top end of said transition portion is configured to recede along said spine, when subjected to external force.

10. An interdental brush according to claim 1, wherein said transition portion tapers towards a top end thereof.

11. An interdental brush according to claim 1, wherein said transition portion is fastened to said main body.

12. An interdental brush according to claim 11, wherein said transition portion is fastened to said main body by mechanical means.

13. An interdental brush according to claim 12, wherein said mechanical means comprises an interlocking mechanism.

14. An interdental brush according to claim 13, wherein said transition portion is embedded in a recess of said main body, and said interlocking mechanism comprises a protruding flange on the outside of said transition portion engaging a protruding part on the inside of said recess.

15. An interdental brush according to claim 1, wherein said main body of said handle part comprises two halves.

16. The interdental brush of claim 1 wherein the spine is non-rotatably fixed relative to the main body.

17. The interdental brush of claim 1 wherein the spine is embedded within the main body.

18. The interdental brush of claim 1 wherein the spine is a single member.

19. An interdental brush comprising:

a handle part having a main body and a substantially resilient transition portion forming a front end of said handle part, wherein said substantially resilient transition portion includes a hollow cavity having a cavity wall, and wherein said main body includes a groove; and a brush member projecting from a front end of said handle part and passes through said hollow cavity, said brush member having a spine and a plurality of bristles coupled thereto, said spine having a width smaller than an interior dimension of the hollow cavity and wherein said spine is spaced apart from the cavity wall without substantial non-elastic restriction along most of the portion of said spine that is within said hollow cavity, said spine having a proximal portion and a distal portion, said spine further having a length that the proximal portion sufficiently extends into said groove of said main body to fixedly secure said brush member to said handle part, wherein a portion of the substantially resilient transition portion contacts said distal portion of said spine of the brush member.

20. The interdental brush according to claim 19, wherein the main body includes two halves and fitting the two halves together secures the spine in the groove.

21. The interdental brush according to claim 19, wherein the spine includes a plurality of bristles coupled thereto, the bristles each extending about perpendicular to the spine.

22. The interdental brush of claim 19, wherein said main body of said handle part does not extend substantially into said hollow cavity of said transition portion and thereby said main body of said handle part not substantially contacting said spine that is within said hollow cavity of said transition portion.

* * * * *